United States Patent [19]

Jacob

[11] 4,035,685

[45] July 12, 1977

[54] SOLID CATHODE CAP FOR AN X-RAY TUBE

[75] Inventor: Heinz-Jurgen Jacob, Norderstedt, Germany

[73] Assignee: U.S. Philips Corporation, New York, N.Y.

[21] Appl. No.: 562,902

[22] Filed: Mar. 28, 1975

[30] Foreign Application Priority Data

Apr. 11, 1974 Germany ..... 2417820

[51] Int. Cl.[2] ..... H01J 1/14; H01J 19/06

[52] U.S. Cl. ..... 313/346 R; 313/55; 313/311; 313/330

[58] Field of Search ..... 313/330, 346, 311, 55, 313/340

[56] References Cited

U.S. PATENT DOCUMENTS

| | | | |
|---|---|---|---|
| 2,310,811 | 2/1943 | Schantl et al. | 313/340 X |
| 2,378,164 | 6/1945 | Van Den Bosch et al. | 313/340 X |
| 2,732,512 | 1/1956 | Briggs, Jr. | 313/446 |
| 2,905,841 | 9/1959 | Meyer et al. | 313/330 X |
| 3,631,290 | 12/1971 | Loeffler | 313/311 |
| 3,646,380 | 2/1972 | Hartl | 313/330 |
| 3,721,847 | 3/1973 | Terasawa | 313/330 |
| 3,906,271 | 9/1975 | Aptt, Jr. | 313/346 |

*Primary Examiner*—Saxfield Chatmon, Jr.
*Attorney, Agent, or Firm*—Frank R. Trifari

[57] ABSTRACT

A cathode for an X-ray tube including an emitter and a cap of a ceramic material such as $Al_2O_3$ surrounding the emitter and having an open part surrounding an exit portion of the emitted electron beam.

4 Claims, 4 Drawing Figures

SOLID CATHODE CAP FOR AN X-RAY TUBE

The invention relates to a solid cathode cap for an X-ray tube.

The importance of the cathode cap for an X-ray tube will be described in detail with reference to FIG. 1.

Figure 1:
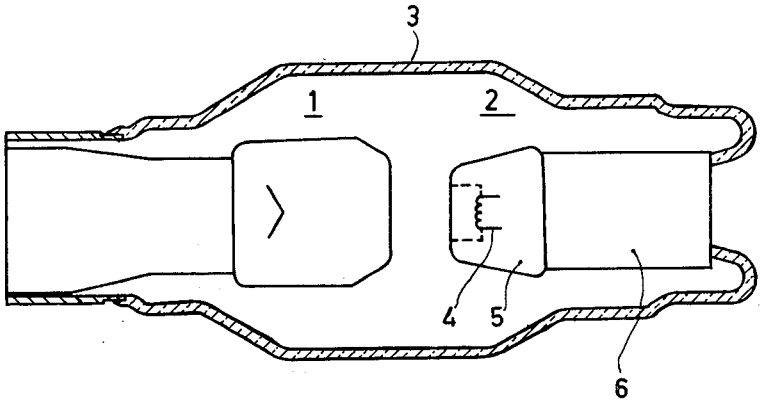

FIG. 1 shows an X-ray tube comprising a (glass) envelope 3 which encloses the anode 1 and the cathode 2 in a vacuumtight manner. The cathode 2 in this case consists of a filament 4 which emits electrons in the operating condition, a cathode cap 5 which encloses the filament 4, and a cathode sleeve 6 which is not shown in detail and which supports the filament 4 and the cathode cap 5 and which connects the cathode cap to the glass envelope 3. The cathode cap 5 also performs an electron-optical function, i.e. the cap serves to influence the path of the electrons emitted by the filament 4 and hence also a focal spot formed on an anode by the beam of electrons in the desired manner. To this end, the electrical field in the vicinity of the filament must be influenced; consequently, the cathode cap in known X-ray tubes is made of metal as an electrically conductive material.

The cathode cap is preferably solid, because a non-solid cathod cap, for example, made of sheet metal, would be distorted at the temperatures occurring in the cathode cap during operation of an X-ray tube (600°–700° C), and because minor deformations of the cathode cap already have a substantial effect on the electron path and hence on the position and the shape of the focal spot. The manufacture of such solid metal cathode caps is very expensive, because milling, machining and drilling operations must be performed with very narrow tolerances. During operation of an X-ray tube, gases are released from the interior by diffusion due to the heating of the cathode cap, the said gases having an adverse effect on the gas atmosphere of the X-ray tube, i.e. the vacuum is adversely affected. This may cause electrical disturbances during operation of the X-ray tube.

The present invention has for its objects to realize a cathode cap for an X-ray tube which can be manufactured cheaper and in which less gas is released during operation of the X-ray tube. To this end, a cathode cap of the kind set forth according to the invention is characterized in that it is made of ceramic material, also on a side facing the anode. Ceramic material has been previously used in X-ray tubes, but so far only as an insulator for X-ray tubes comprising a metal envelope or for metallized cathode caps. In a further preferred embodiment according to the invention, particularly good use is made of a cathode cap made of vacuumtight aluminium oxide ceramic. A commercially available vacuumtight $Al_2O_3$ ceramic contains more than 90% (97.6%) $Al_2O_3$, has a density of 3.76 g/cm$^3$, a breakdown strength of 43 kV/mm and a relative dielectric constant of from 9 to 10 (for example, ceramic material Al-300). The heat conductivity is better than that of $V_2A$ steel. A property of an aluminium oxide ceramic which is important for the use in a cathode cap is the fact that substantially no gases are released when the cap is heated to 600° C and beyond, i.e. the temperatures which can be reached by a cathode cap during normal operation.

It is a further advantage that elements of aluminium oxide ceramic can be machined with tolerances of less than 1/10 mm, without finishing treatment of the ceramic element, fired at 1800° C, being required. Because, considering these small manfacturing tolerances, no finishing operation is required, a cathode of (aluminium oxide) ceramic is substantially cheaper than a metal cathode.

Ceramic elements, notably elements of aluminium oxide ceramic, can be readily metallized. When such a ceramic cathode cap is fully metallized, the same relationships occur as regards the geometry and the strength of the electrical field inside the X-ray tube as for a metal cathode cap having the same shape and dimensions. From the comparatively thin metallizing layer, like from the aluminium oxide itself, only comparatively small quantities of gas are released during operation of the X-ray tube.

However, it is not absolutely necessary to metallize the cathode cap. In the case of a non-metallized cathode cap, the thermal emission of the ceramic body, being substantially larger than, for example, that of $V_2A$ steel, can be fully utilized. The cathode cap then becomes substantially less hot, so that in given applications separate cooling of the cathode (required for metal cathode caps in given circumstances) can be dispensed with. This also has a favorable effect on the service life and the breakdown strength of the tube.

Further advantages will be defined in detail hereinafter with reference to the preferred embodiments according to the invention shown in the drawing.

Figure 2A:
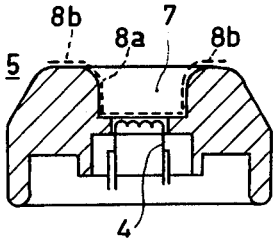
Figure 2B:
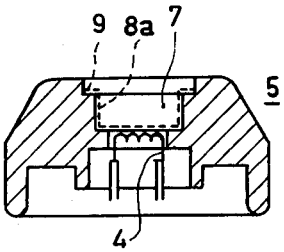
Figure 2C:
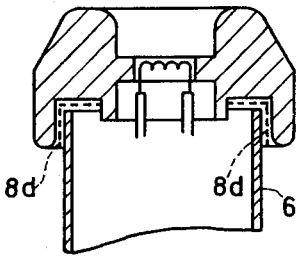

FIG. 1 is an illustration of an X-ray tube comprising the inventive embodiments of FIGS. 2*a*, 2*b*, and 2*c*.

FIG. 2*a* shows a first embodiment of a filament and a cathode cap,

FIG. 2*b* shows a further embodiment of such a cathode cap, and

FIG. 2*c* shows a cathode cap which is metallized at the area facing the cathode sleeve.

The cathode cap 5 shown in a cross-sectional view in FIG. 2*a* comprises a recess 7 in the middle of the portion which faces the anode in the X-ray tube. On the lower side of the recess there is provided a narrow groove in which the filament 4 of the cathode projects, the cathode being rigidly mounted relative to the cathode cap in a known manner which is not shown in the drawing. The recess 7 is usually deeper as the electron path in the X-ray tube is longer. When such recess is metallized, a metallization layer 8, denoted by a broken line, is at cathode potential. The metallization of the recess influences the electron path and the focal spot in the same manner as if the cathode cap were made of metal. However, it is not necessary to provide this metallization. Proper focussing is achieved also without metallization, and the advantages described in the preamble are also achieved. On the edges of the metallization layer very often very high electrical field strength occur. These fields may give rise to flash-over or to other tube disturbances. This can be avoided by utilizing a cathode cap geometry as shown in FIG. 2*b*. In this Figure the upper part of the recess 7, i.e. the part facing the anode, is widened, and the metallization layer 8 terminates in the corner of the widened portion 9. Besides the complete emission of the metallization, it is alternatively possible to keep the metallized portion of such a recess comparatively small.

FIG. 2*c* shows the cathode cap 5 in combination with the upper end of the cathode sleeve 6. As is denoted by broken lines 8 in the drawing, the lower side of the cathode cap, facing the cathode sleeve, is metallized. As a result, besides the already said advantages the following further advantages are realized (possibly in combination with a minor metallization of the recess acccording to FIG. 2*b* ): the metallization of constitutes a shield for the sharp edges at the upper side of the envelope. Therefore, very high field strengths cannot occur at this area, so that flash-overs or breakdowns cannot occur either. It is particularly important that, because of the metallization, the thermal emission at this area is substantially reduced, particularly when a nickel layer is used. as a result, the amount of heat applied to the cathode sleeve 6 during operation of the X-ray tube is further reduced, whilst the depletion of heat to the free space is greater than in the case of metallic or metallized caps.

In rotary anode X-ray tubes in which the stator field in not especially screened, the risk exists that the magnetic field of the stator influences the electron path and hence the shape and the position of the focal spot. This risk can be avoided by arranging an iron cap of weak magnetic material, for example, a fernico alloy, provided with a gauze grid at the top over the cathode cap. In order to ensure that the iron cap bears on the cathode cap in a well-defined manner, the cathode preferably has a cylindrical shape so that the iron cap can be fitted over the cylinder, for example, as far as a flange at the lower end of the cathode cap. Deformation of the iron cap by the cathode cap which comes very near to the iron cap in the upper part is substantially precluded because of the high shape stability of the cathode cap.

What is claimed is:

1. A cathode for an X-ray tube comprising means for emitting an electron beam and a cap of ceramic material surrounding said emitting means and having an open part surrounding an exit portion of said beam, the surface of said open part of said cap being provided with a conductive layer, said open part having a step and said conductive layer terminating on said step.

2. A cathode as claimed in claim 1, wherein the cap is made of a vacuum-tight aluminum oxide ceramic.

3. A cathode for an X-ray tube comprising means for emitting an electron beam and a cap of ceramic material surrounding said emitting means and having an open part surrounding an exit portion of said beam, a sleeve for supporting said cap, and a conductive layer provided between facing surface portions of said cap and sleeve.

4. A cathode as claimed in claim 3, wherein the cap is made of a vacuum-tight aluminum oxide ceramic.

* * * * *